US009187917B2

(12) United States Patent
Barnes et al.

(10) Patent No.: US 9,187,917 B2
(45) Date of Patent: Nov. 17, 2015

(54) WIRE BINDING MACHINE

(75) Inventors: Graham Frank Barnes, Surrey (GB); Ian David Coles, West Sussex (GB); Paul Anthony Goater, West Sussex (GB)

(73) Assignee: CONSTRUCTION TOOLS PC AB, Kalmar (SE)

( * ) Notice: Subject to any disclaimer, the term of this patent is extended or adjusted under 35 U.S.C. 154(b) by 0 days.

(21) Appl. No.: 13/264,832

(22) PCT Filed: Apr. 16, 2010

(86) PCT No.: PCT/GB2010/000768

§ 371 (c)(1), (2), (4) Date: Nov. 16, 2011

(87) PCT Pub. No.: WO2010/119260

PCT Pub. Date: Oct. 21, 2010

(65) Prior Publication Data

US 2012/0055577 A1 Mar. 8, 2012

(30) Foreign Application Priority Data

Apr. 16, 2009 (GB) ..... 0906575.6

(51) Int. Cl.
*E04G 21/12* (2006.01)
*B65B 13/28* (2006.01)

(52) U.S. Cl.
CPC ..... *E04G 21/122* (2013.01); *B65B 13/285* (2013.01)

(58) Field of Classification Search
USPC ..... 140/93.2, 123.5, 117, 118, 119
See application file for complete search history.

(56) References Cited

U.S. PATENT DOCUMENTS

| | | | | |
|---|---|---|---|---|
| 1,809,566 | A | | 6/1931 | Ekern |
| 2,919,894 | A | | 1/1960 | Hepler |
| 3,028,885 | A | | 4/1962 | Leslie et al. |
| 3,632,959 | A | * | 1/1972 | Nelson et al. ..... 219/60 R |
| 3,718,798 | A | * | 2/1973 | Randolph et al. ..... 219/60 A |
| 4,362,192 | A | | 12/1982 | Furlong et al. |
| 4,508,030 | A | | 4/1985 | Grenon |
| 4,542,773 | A | | 9/1985 | Lafon |
| 4,655,264 | A | | 4/1987 | Dilley |
| 4,953,598 | A | * | 9/1990 | McCavey ..... 140/119 |
| 5,004,020 | A | | 4/1991 | Meinershagen |
| 5,311,721 | A | | 5/1994 | Urchaga |
| 5,323,816 | A | | 6/1994 | Hoyaukin |
| 5,778,945 | A | | 7/1998 | Crowther |

(Continued)

FOREIGN PATENT DOCUMENTS

| | | |
|---|---|---|
| CH | 648085 | 2/1985 |
| DE | 1511828 | 9/1966 |

(Continued)

*Primary Examiner* — Shelley Self
*Assistant Examiner* — Mohammad I Yusuf
(74) *Attorney, Agent, or Firm* — Knobbe Martens Olson and Bear

(57) ABSTRACT

A machine (4) for tying a length of wire (46) around one or more objects (2) comprising a wire feed mechanism adapted to feed wire (46) from a spool during a first phase; and to withdraw the wire (46) during a second phase, said wire feed mechanism comprising a gripping mechanism (102, 103) including a pair of rollers urged together to grip the wire (46) therebetween and drive it in the appropriate direction, said gripping mechanism (102, 103) being configured such that during said second phase, increasing tension in the wire (46) automatically increases the gripping force on the wire (46).

11 Claims, 9 Drawing Sheets

(56) References Cited

U.S. PATENT DOCUMENTS

| | | | | |
|---|---|---|---|---|
| 5,826,629 | A | 10/1998 | West | |
| 5,947,166 | A * | 9/1999 | Doyle et al. | 140/119 |
| 6,041,833 | A | 3/2000 | Suric | |
| 7,051,650 | B2 | 5/2006 | Kusakari et al. | |
| 7,140,400 | B2 * | 11/2006 | Yokochi et al. | 140/119 |
| 7,143,792 | B2 * | 12/2006 | Ishikawa et al. | 140/119 |
| 7,275,567 | B2 * | 10/2007 | Ishii et al. | 140/119 |
| 8,844,434 | B2 | 9/2014 | Barnes et al. | |
| 2003/0010225 | A1 | 1/2003 | Pearson et al. | |
| 2006/0157139 | A1 | 7/2006 | Hoyaukin | |
| 2011/0155277 | A1 | 6/2011 | Barnes | |
| 2012/0111206 | A1 | 5/2012 | Barnes | |
| 2012/0132088 | A1 | 5/2012 | Barnes et al. | |

FOREIGN PATENT DOCUMENTS

| | | | |
|---|---|---|---|
| DE | 19806995 | | 9/1999 |
| EP | 0 757 143 | A1 | 7/1996 |
| EP | 1 415 917 | A | 6/2004 |
| EP | 1 557 359 | A1 | 7/2005 |
| FR | 1576602 | | 6/1969 |
| FR | 2552364 | A1 | 3/1985 |
| GB | 1 533 508 | | 5/1997 |
| JP | 2000-064617 | A | 2/2000 |
| WO | 93/02816 | A | 2/1993 |
| WO | WO 2004/083559 | | 9/2004 |
| WO | WO 2007/042785 | A2 | 4/2007 |

* cited by examiner

WIRE BINDING MACHINE

BACKGROUND OF THE INVENTION

This invention relates to machines for tying wire bindings around reinforcement bars as used in the construction of reinforced concrete.

WO 2007/042785 gives an example of a wire binding machine used for tying wire loops around intersections of steel reinforcement bars for constructing reinforced concrete structures. The design of machine shown in this document has been shown to produce tight and reliable ties in a practical and compact package. However as with any battery-powered tool, it would always be desirable to be able to reduce its power consumption even further in order to extend battery life or allow a smaller and therefore lighter battery to be used.

The Applicant has now appreciated that one area where a reduction in power consumption might be possible is in the motor used to feed the wire from the spool to the head and to withdraw it again to pull the loop tight prior to spinning.

When viewed from a first aspect the present invention provides a machine for tying a length of wire around one or more objects comprising a wire feed mechanism adapted to feed wire from a spool during a first phase; and to withdraw the wire during a second phase, said wire feed mechanism comprising a gripping mechanism including a pair of rollers urged together to grip the wire therebetween and drive it in the appropriate direction, said gripping mechanism being configured such that during said second phase, increasing tension in the wire automatically increases the gripping force on the wire.

Thus it will be seen by those skilled in the art that in accordance with the invention the grip on the wire increases with wire tension during the second, retraction phase. The invention involves a recognition by the Applicant that a much greater gripping force on the wire is required in the second phase, especially during the latter part thereof if the wire is to be pulled tightly around the reinforcement bars. It has been recognised accordingly that during the first phase there is a lower gripping force requirement as it is only necessary for the drive mechanism to overcome the friction encountered by the wire in being withdrawn from the spool and fed through the machine.

In previously proposed arrangements the grip on the wire was set at a constant high value to ensure sufficient tension could be applied to it during the second, retraction phase to ensure a good tie. However this meant the torque in the driving motor and so the current used by the drive mechanism was higher than it needed to be in the first phase. By employing an automatically increasing grip as the tension in the wire increases as result of wire is drawn tightly, the grip and so current drawn can be kept low during the first phase without compromising how tightly the loop can be drawn during the second phase.

SUMMARY OF THE INVENTION

There are many possible mechanisms for achieving the functionality set out above. For example a secondary motor or solenoid could be employed to apply the gripping force, e.g. with a feedback mechanism sensitive to the tension in the wire controlling the applied force. Preferably however a purely mechanical arrangement is employed. Preferably at least one of the rollers is connected to a gear which is driven by a drive gear, such as a pinion, connected to a motor. Such connection between the drive gear and the motor could be by it being directly fixed onto the motor driveshaft, or by indirect coupling through a gearbox, clutch or other coupling arrangement.

The other roller could be entirely passive, i.e. acting as an idler, in which case it would not need a gear. Preferably however it, too is attached to a respective gear. This could be driven by another drive gear, coupled either to the same or a separate motor. Preferably however it is driven by the first roller gear.

In one set of preferred embodiments the drive gear and the roller gear it engages are mounted to allow a degree of separation between their respective axes such that a gear separation force acting between them is such as to urge the respective roller onto the wire, thereby increasing the gripping force. In such embodiments as the tension in the wire increases, the torque transmitted by the roller and drive gears also increases. Their respective mountings allow the resultant natural tendency to separate to urge the associated roller tighter onto the wire. In a preferred such arrangement the roller is mounted so that its axis can pivot relative to the drive gear about a point offset from the axis of the drive gear.

In another set of preferred embodiments the axes of the drive and roller gears are at a fixed spacing, the roller gear being mounted to allow it to precess around the drive gear to urge the roller tighter onto the wire. In a preferred embodiment the roller is mounted so that it can pivot towards and away from the wire. The meshing element could for example be mounted on an arm or plate. In a preferred set of embodiments the rotation is centred on the pinion. In a preferred such arrangement the roller is mounted so that its axis can pivot relative to the drive gear about the axis of the drive gear.

In light of the above it can be seen that in one set of preferred embodiments the roller gear which is engaged by the drive gear is mounted so that its axis can pivot relative to the axis of the drive gear. The pivot axis may either be the drive gear axis or it may be offset from it.

In either case both rollers could be directly driven and one of the outlined arrangements provided for the other roller. Preferably though only one roller is directly driven and the axis of the other (non-driven) roller is fixed relative to that of the drive gear.

In general the rollers are preferably resiliently biased together. This can be used to set an initial preload suitable for the first (feed-out) phase.

BRIEF DESCRIPTION OF THE DRAWINGS

Certain preferred embodiments of the invention will now be described, by way of example only, with reference to the accompanying drawings in which.

DETAILED DESCRIPTION OF THE PREFERRED EMBODIMENT

The embodiments described below with reference to FIGS. 6 and 7 may be applied to any machine for tying wire bindings around a pair of steel concrete reinforcement bars. For the purposes of reference however a specific example of such a machine will be described below with reference to FIGS. 1 to 5.

Figure 1A:
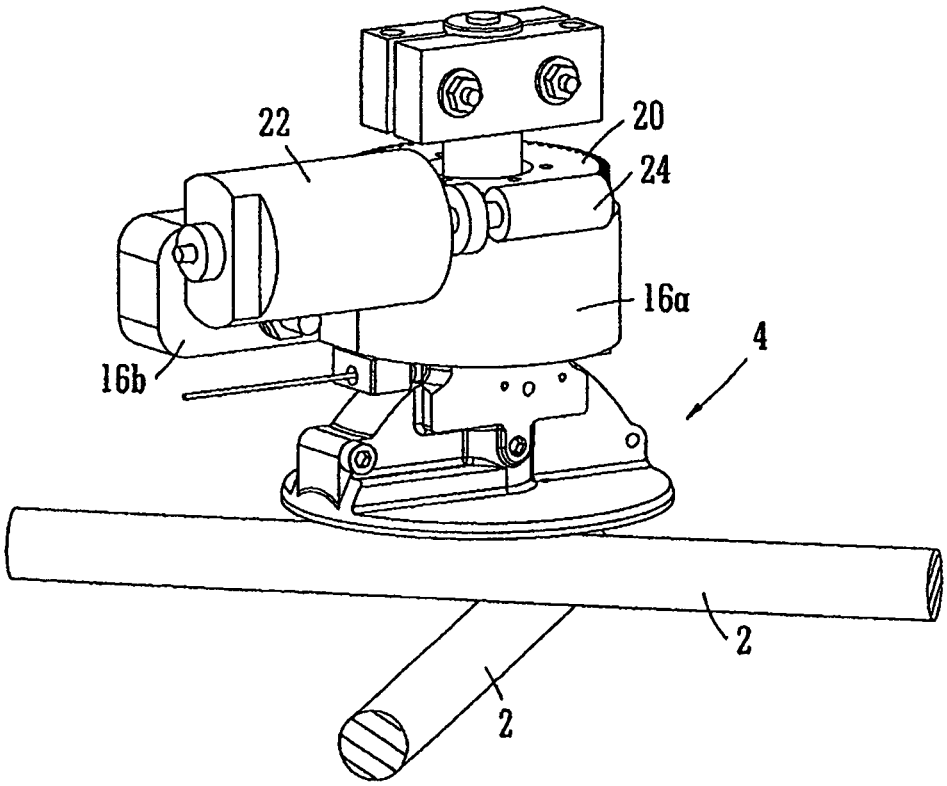
FIG. 1A is a perspective view of a wire tying apparatus above a pair of crossed bars prior to a tying operation being initiated.
Figure 1B:
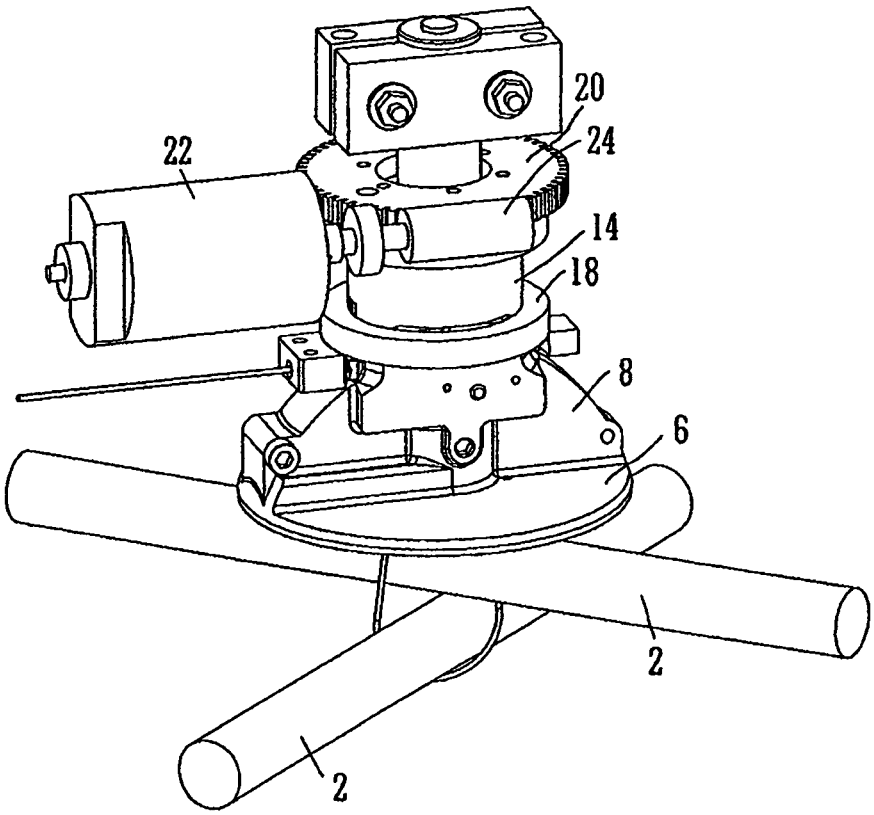
FIG. 1B is a view similar to FIG. 1A with the main mounting bracket removed.
Figure 2:
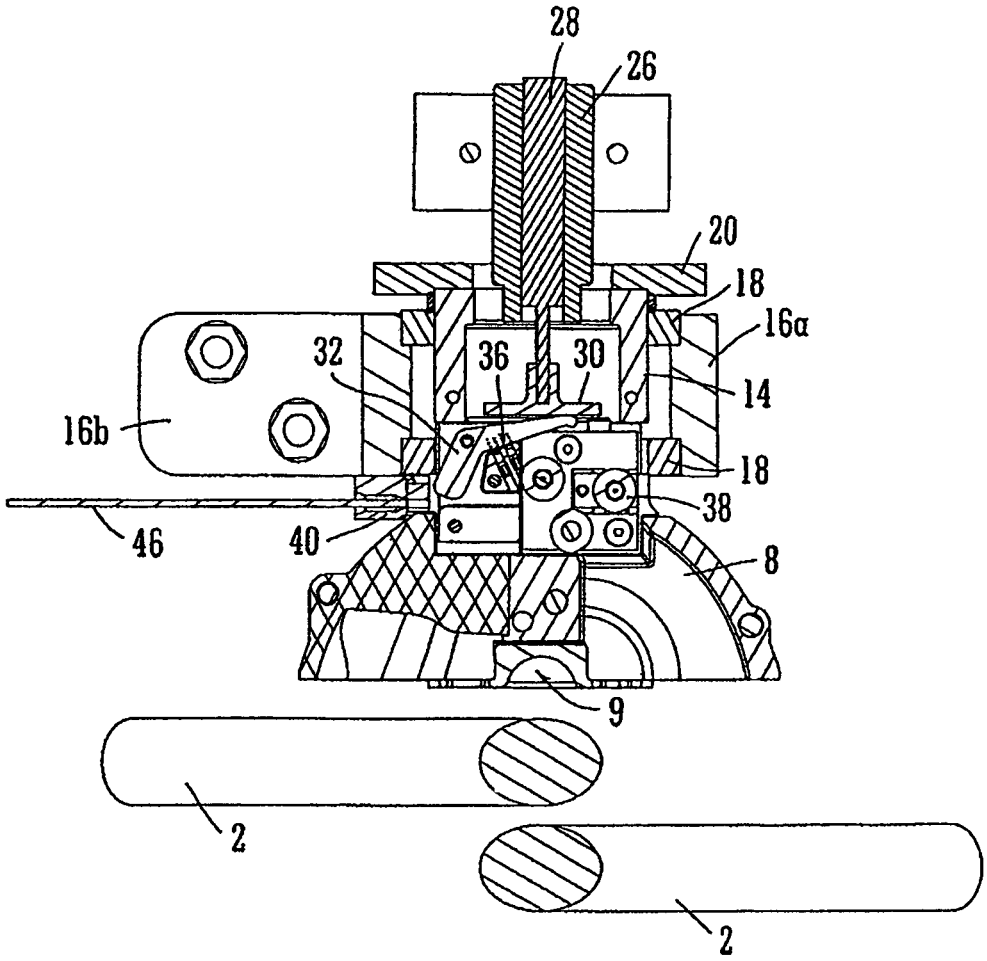
FIG. 2 sectional view through the apparatus shown in FIG. 1.

Referring first to FIGS. 1A, 1A and 2 there are shown two perspective views and a sectional view respectively of part of a wire tying apparatus with certain parts such as the housing, handle, battery, controls, shroud and wire spool removed for clarity. The apparatus is shown situated over a junction where two steel bars 2 cross over each other at right angles. The steel bars 2 are intended to form a rectangular grid to be embedded in a concrete structure in order to reinforce it. Although not shown, a domed shroud is provided around the lower end of the apparatus and has two part-circular depressions so that the apparatus can securely rest on the upper of the two bars 2 without slipping off.

Figure 3:
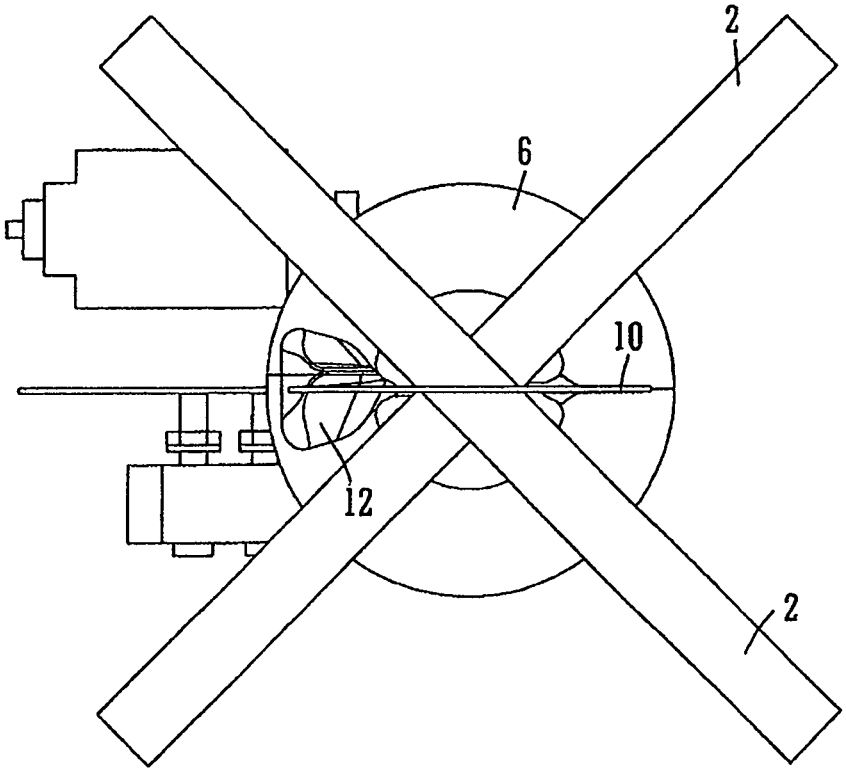
FIG. 3 is a view of the apparatus from beneath.

Sitting in use above the uppermost bar 2 is the rotary head of the apparatus 4. This includes a horizontal circular base plate 6 extending up from which is a channel 8 which is approximately semi-circular in vertical section and of approximately constant width in the orthogonal direction. In the centre of base plate 6 is a part-spherical depression 9. The underneath of the base plate 6 is shown in FIG. 3 from which it will be seen that on one side there is a narrow slot 10 corresponding to one end of the semi-circular channel and on the other side of the plate 6 corresponding to the other end of the channel is a funnel region 12.

Returning to FIGS. 1A, 1B and 2, attached to the semi-circular channel 8 is the upper cylindrical portion of the head 14 which is rotatably mounted in the cylindrical portion 16*a* of a bracket member mounted to the housing (not shown) by a flange portion 16*b* (omitted from FIG. 1A). The upper head portion is supported by two rotary bearings 18. A toothed gear wheel, 20 is provided fixed at the top of the head to allow it to be driven by a motor 22 via a worm gear.

Extending through the gear wheel 20 into the open upper end of the head 4 is a solenoid assembly comprising a cylindrical outer tube 26 housing the coil and an inner plunger 28 which is able to slide vertically relative to the coil 26. At the bottom end of the plunger 28 is an actuating disc 30, the purpose of which will be explained later.

The internal construction of the head 4 will now be described. On the left hand side as seen from FIG. 2, there may be seen a pivotally mounted angled clutch lever 32. A pair of compression springs 36 act on the longer, upper arm of the lever 32 so as to bias the lever in an anti-clockwise direction in which the shorter, lower arm is pressed downwardly. Of course any number of springs might be used. To the right of the clutch lever 32 are a series of roller wheels 38*a*, 38*b*, 38*c* the purpose of which will be explained below. A similar clutch lever is provided displaced approximately 180 degrees around the head. This is not therefore visible in the sectional view.

To the left of the upper head portion 14 connected to the main bracket flange portion 16*b* is a wire feed inlet guide 40 which receives the free end of wire 46 from a wire feed module described in greater detail below with reference to FIGS. 6 and 7.

Figure 6:
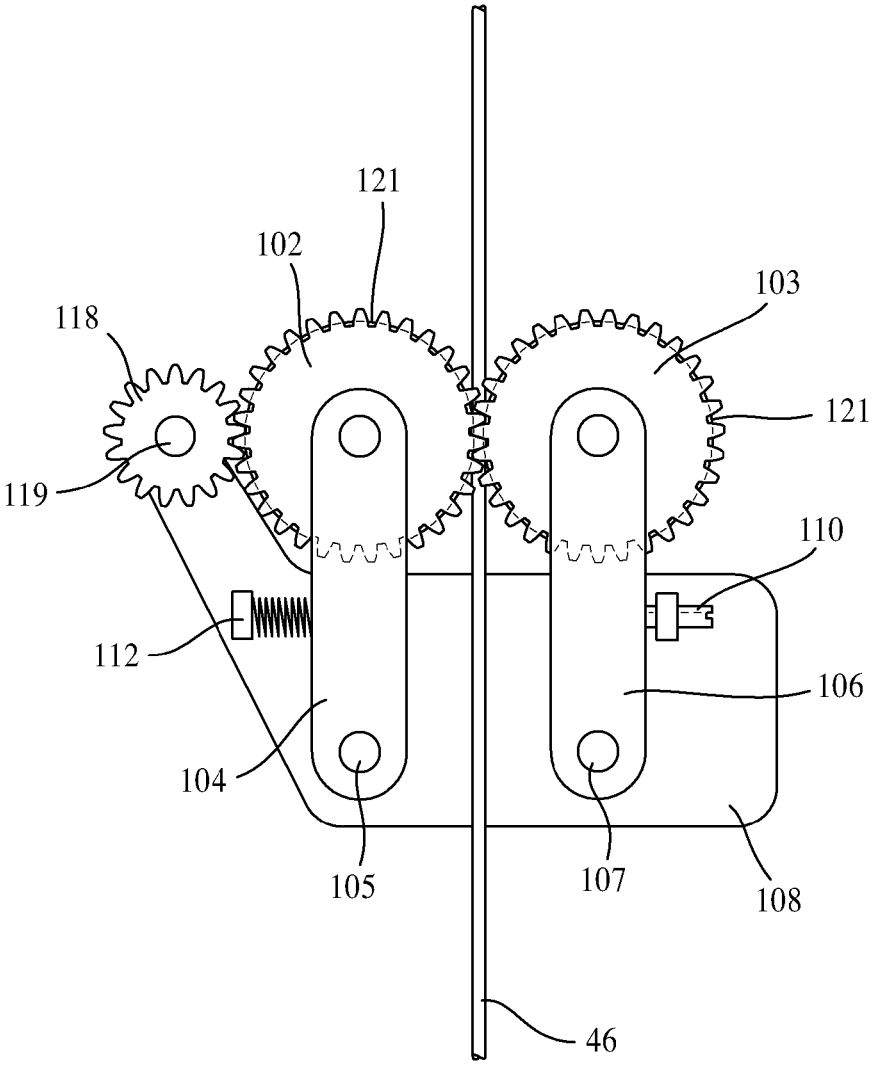
FIG. 6 is a diagram illustrating a first embodiment of the invention.

An example of a wire feed mechanism which embodies the invention is shown in FIG. 6. Here it will be seen that two meshing gears 102, 103 are rotatably mounted on respective arms 104, 106. The arms 104, 106 are mounted for at least limited pivotal movement about respective pivot axes 105, 107 on a support plate 108. A set screw 110 is used to set the position of the right-hand arm and thus act as a stop against clockwise pivotal movement of the right-hand mounting arm 106. The left-hand arm 104 is similarly acted upon by an adjustable spring stop 112. Between them the set screw 110 and adjustable spring 112 act to provide a resilient force biasing the two gears 102, 103 together. Behind each gear 102, 103 and attached to the same respective shafts are respective friction rollers 121 which grip the wire 46 that passes between them.

The support plate 108 has an extension 116 on one side which mounts a motor (not visible) that drives a pinion 118. The pinion 118 engages the left-hand roller gear 102 so that rotation of the pinion drives the left roller gear 102 directly, with the right roller gear 103 being driven indirectly by the left one. It will be noted that the axis 119 of the pinion 118 is offset from the axis 105 of the driven roller gear 102.

Operation of the wire tying apparatus will now be described. The apparatus is first brought down onto the uppermost of a pair of steel reinforcing bars 2 which are crossed at right angles. When the shroud 42 is properly resting on the bar 2, the presence of the steel will be sensed by the two Hall effect sensors 44 which will allow the tying operation to be commenced. If the operator should attempt to commence the tying operation before both Hall effect sensors 44 sense the presence of the steel bar 2, a warning light such as an LED is illuminated and further operation of the apparatus is prevented.

Once the steel bar 2 is properly sensed, the operator may commence the tying operation. The first part of this operation is to energise the solenoid coil 26 which pushes the plunger member 28 downwardly. This causes the actuating member 30 at the end of the plunger to be pressed downwardly onto the upper arms of the clutch levers 32 to press them down against the respective compression springs 36 and therefore raise the shorter, lower arms. This is the position which is shown in FIG. 2.

Thereafter the main motor 22 is, if necessary, operated just long enough to rotate head 4 via the worm drive and gear wheel 24, 20 so that a channel for receiving the wire 46 is in correct alignment with the wire feed inlet guide 40. This is called the "park" position.

Once the head 4 is in the "park" position, the wire feed module is operated to feed wire form the spool (not shown). With reference to FIG. 6 the motor driving the pinion is operated to drive it anticlockwise in order to drive the two friction rollers 121 to feed the wire 46 downwardly in the sense of FIG. 6. Of course this corresponds to feeding it rightwards into the machine as it is oriented in FIG. 2. The wire 46 is therefore fed into the wire inlet guide 40 and into the aligned channel in the upper head portion 14. The wire is fed in horizontally and encounters the first of the passive rollers 38*a*. The first roller 38*a* causes the wire to bend downwardly slightly so that it passes between the second and third rollers 38*b*, 38*c*. The relative positions of the three passive rollers 38*a*, 38*b*, 38*c* is such that when the wire 46 emerges from them it is bent so as to have an arcuate set. As the wire 46 continues to be driven by the wire feed module, it encounters and is guided by the inner surface of the semi-circular channel 8.

Figure 4:
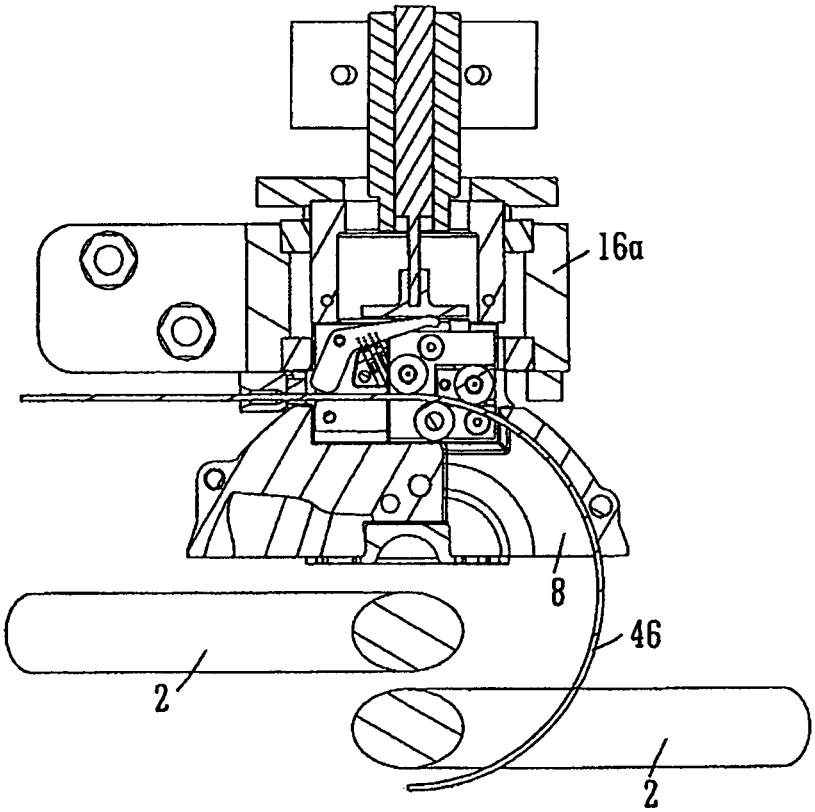
FIG. 4 is a sectional view similar to FIG. 2 showing the apparatus part-way through a tying operation.

When the wire 46 emerges from the channel 8, its arcuate set causes it to continue to describe an approximately circular arc, now unguided in free space, around the two reinforcing bars. This is shown in FIG. 4. As the wire 46 continues to be driven, the free end will eventually strike the mouth of the funnel region 12 in the bottom of the base plate 6 and therefore be guided back into the semi-circular channel 8. However it is not guided back precisely diametrically opposite where it was issued from but rather slightly laterally offset therefrom. This allows the receiving means in the form of a further clutch lever (not shown) to be located next to the first clutch lever 32 which enables the apparatus to be kept relatively compact.

Throughout the wire feed operation the wire encounters relatively little resistance. The gripping force provided by the spring stop 112 (see FIG. 6) acting on the friction rollers 121 through the mounting arm 104 is sufficient to prevent slipping.

As the free end of the wire re-enters the semi-circular channel 8, it encounters the second clutch lever. This can be detected by sensing a slight displacement of the lever or by a separate sensor such as a micro switch, Hall effect sensor or other position detection means.

Once the free end of the wire 46 is detected, the motor driving the pinion 118 is stopped and therefore the wire does not advance any further. At this point the solenoid coil 26 is then de-energised which causes the plunger 28 to be retracted by a spring (not shown) which releases the two clutch levers 32 so that their respective compression springs 36 act to press their lower arms against the two ends of the wire loop and therefore hold the wire 46 in place.

Figure 5A:
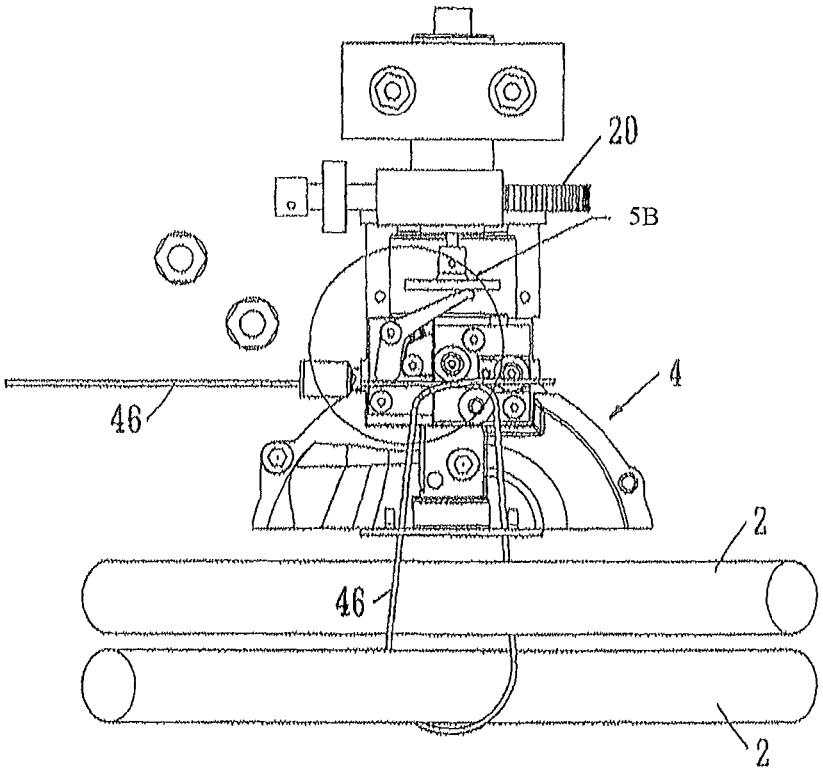
FIG. 5A is another sectional view showing the wire tensioned prior to twisting.
Figure 5B:
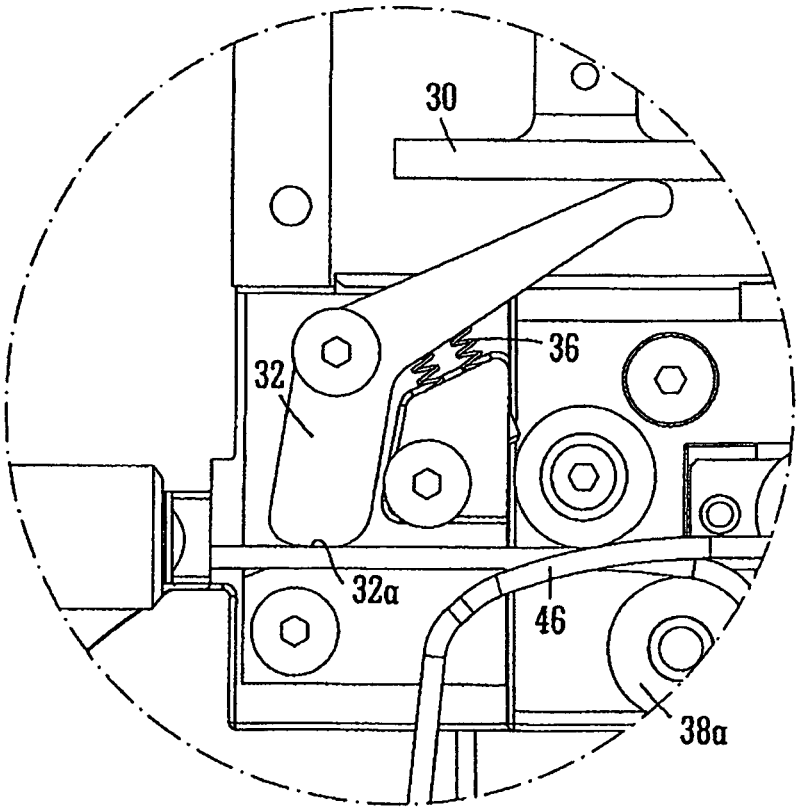
FIG. 5B is an enlargement of the circled part of FIG. 5A.

The wire feed motor is then driven in reverse, i.e, to drive the pinion clockwise in order to retract the wire 46 upwards as viewed from FIG. 6 and so apply tension to the wire loop which draws the wire in around the reinforcing bars 2, see FIG. 5A. FIG. 5B shows detail of the clutch lever 32 on the feed side clamping the end of the wire 46. A similar arrangement clamps the other end of the wire as explained above.

As the wire loop gets tighter the tension in the wire 46 increases. This translates into an increase in the torque applied by the pinion 118 to the driven roller gear 102. The result of this is a tendency for the pinion 118 and roller gear 102 to separate—i.e. move out of mesh. This is allowed to a limited extent by the pivotal mounting of the roller gear 102 which thus forces the gear 102 and its associated roller 121 tighter against the wire to increase the gripping force on the wire significantly. The other roller 121 provides a reaction force because of its mounting on the pivot arm 106 acted on by the fixed set screw 110. The relative spacings of the gears 118, 102, 103 is such that the pivot arm cannot move enough for the pinion 118 and roller gear 102 to come fully out of mesh.

This arrangement acts as a positive feedback system since higher the gripping force the greater the force that can imparted to the wire 46. To give an example during the wire feed phase the compression in the wire might only be 20 Newtons, whereas at the maximum tension when the wire loop is pulled fully tight it can rise to 120 Newtons. When the torque on the motor reaches a predetermined threshold (e.g. as measured by its drawn current) the retraction phase is stopped. The clutches 32 maintain the tension in the loop.

When the wire 46 is fully tensioned it will be seen from FIG. 5A that the two ends of the loop are pulled up almost vertically from their initial circular profile. As the head 4 tries to start rotating at the beginning of the twisting operation the torque supplied by the head motor 22 is sufficient to shear the wire at the point where it crosses from the inlet guide 40 to the upper head portion 14 without the need for it to be cut. If necessary an initial surge current (e.g. boosted by a charge stored in a capacitor) can be supplied to the motor 22 to deliver an initial spike in torque but this is not essential. With the wire thus broken, the head 4 begins to twist the sides of the loop together above the reinforcing bars 2 as is known per se in the art.

Figure 7:
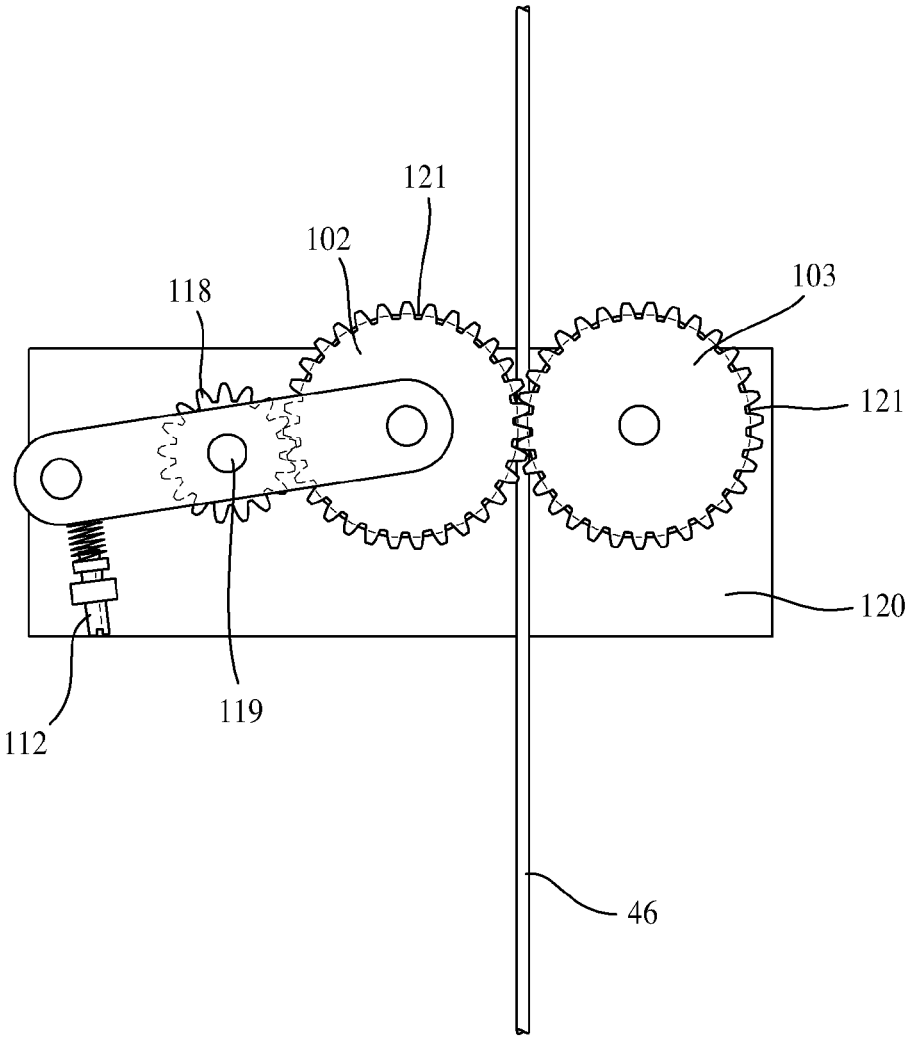
FIG. 7 is a diagram illustrating a second embodiment.

FIG. 7 shows a different embodiment of the wire feed module although components common to the first embodiment are denoted by the same reference numerals. In this embodiment the shaft of the indirectly driven roller 121 and its gear 103 is fixedly mounted on the base plate 120. On the other hand the directly driven roller 121 and its gear 102 are mounted on a pivoting arm 122 which is this time pivoted, approximately at its centre, about the axis 119 of the driving pinion 118. A set spring 105 is provided but this acts on the other end of the lever arm 122 to the roller gear 102. In the rest position shown in FIG. 7 the arm 122 is inclined slightly so that it is not perpendicular to the wire 46.

During the initial feeding phase of the wire 46, operation is similar to the first embodiment with the pinion being driven anti-clockwise and the gripping force on the wire being provided by the set spring 112. During the retraction phase however, in which the wire 46 is pulled upwardly as seen from FIG. 7, the pinion 118 and driven roller gear 102 will not come out of mesh since they are effectively mounted at a fixed axial spacing because the pivot axis of the arm is the same as the axis of the pinion. Instead as tension in the wire 46 increases, the arm 122 will tend to pivot clockwise a small amount to allow the roller gear 102 to precess around the pinion 118 and so bring it towards the perpendicular. This reduces the centre-to-centre spacing of the two rollers 121 and so increases the gripping force on the wire.

During the initial feeding phase of the wire 46, operation is similar to the first embodiment with the pinion being driven anti-clockwise and the gripping force on the wire being provided by the set spring 112. During the retraction phase however, in which the wire 46 is pulled upwardly as seen from FIG. 7, the pinion 118 and driven roller gear 102 will not come out of mesh since they are effectively mounted at a fixed axial spacing because the pivot axis of the arm is the same as the axis of the pinion. Instead as tension in the wire 46 increases, the arm 122 will tend to pivot clockwise a small amount to allow the roller gear 102 to precess around the pinion 118 and so bring it towards the perpendicular. This reduces the centre-to-centre spacing of the two rollers and so increases the gripping force on the wire.

Again a positive feedback loop is set up until a threshold torque in the motor is reached as in the previous embodiment.

What is claimed is:

1. A machine for tying a length of wire around one or more objects comprising a wire feed mechanism adapted to feed wire from a spool during a first phase; and to withdraw the wire during a second phase, said wire feed mechanism comprising a gripping mechanism including a pair of rollers urged together to apply a gripping force on the wire to grip the wire therebetween and drive the wire in an appropriate direction, wherein one of said rollers is connected to a roller gear and the other of said rollers is connected to a drive gear connected to a motor and said roller gear is driven by said drive gear, and wherein at least one of the rollers is rotatably mounted on a pivoting arm and said pivoting arm is rotatably mounted on a pivot axis, the pivoting arm extending between the pivot axis and the roller that is rotatably mounted to the pivoting arm, and the pivot axis extending in a direction which is perpendicular to the direction in which the pivoting arm extends, such that during said second phase, increasing tension in the wire automatically causes rotation of the pivoting arm about the pivot axis to move the rollers closer together which increases the gripping force on the wire.

2. A machine as claimed in claim 1 comprising a purely mechanical arrangement to apply the gripping force.

3. A machine as claimed in claim 1 wherein the drive gear and the roller gear are mounted to allow a gear separation force acting between them to urge the respective roller onto the wire, thereby increasing the gripping force.

4. A machine as claimed in claim 3 wherein at least one of the rollers is mounted so that an axis of said roller pivots relative to the drive gear about a point offset from the axis of the drive gear.

5. A machine as claimed in claim 1 wherein the axes of the drive and roller gears are at a fixed spacing, the roller gear being mounted to allow the roller gear to precess around the drive gear to urge at least one of the rollers tighter onto the wire.

6. A machine as claimed in claim 5 wherein at least one of the rollers is mounted so that said roller pivots towards and away from the wire.

7. A machine as claimed in claim 6 wherein the rotation of at least one of the rollers is centred on the drive gear.

8. A machine as claimed in claim 5 wherein at least one of the rollers is mounted so that an axis of said roller pivots relative to the drive gear about the axis of the drive gear.

9. A machine as claimed in claim 5 wherein the roller gear which is engaged by the drive gear is mounted so that an axis of said roller pivots relative to the axis of the drive gear.

10. A machine as claimed in claim 1 wherein one roller is directly driven and the axis of the other roller is fixed relative to that of the drive gear.

11. A machine as claimed in claim 1 wherein the rollers are resiliently biased together.

* * * * *